US005509356A

United States Patent [19]

Renfro

[11] Patent Number: 5,509,356

[45] Date of Patent: Apr. 23, 1996

[54] LINER AND IMPROVED SHAPED CHARGE ESPECIALLY FOR USE IN A WELL PIPE PERFORATING GUN

[75] Inventor: Steven L. Renfro, Windsor Locks, Conn.

[73] Assignee: The Ensign-Bickford Company, Simsbury, Conn.

[21] Appl. No.: 379,702

[22] Filed: Jan. 27, 1995

[51] Int. Cl.[6] ..... B32B 1/00

[52] U.S. Cl. ..... 102/307

[58] Field of Search ..... 102/307

[56] References Cited

U.S. PATENT DOCUMENTS

| | | | |
|---|---|---|---|
| 2,981,185 | 4/1961 | Caldwell | 102/20 |
| 2,986,089 | 5/1961 | Meddick | 102/20 |
| 3,128,701 | 4/1964 | Rinehart et al. | 102/20 |
| 3,147,707 | 9/1964 | Caldwell | 102/24 |
| 3,196,792 | 7/1965 | Charrin | 102/24 |
| 4,109,576 | 8/1978 | Eckels | 102/24 HC |
| 4,220,687 | 9/1980 | Christopher | 102/20 X |
| 4,393,946 | 7/1983 | Pottier et al. | 175/4.56 |
| 4,450,768 | 5/1984 | Bell | 102/307 |
| 4,498,367 | 2/1985 | Skolnick et al. | 102/307 X |
| 4,557,771 | 12/1985 | Bencz et al. | 102/307 X |
| 4,627,353 | 12/1986 | Chawla | 102/307 |
| 4,669,384 | 6/1987 | Chawla et al. | 102/307 |
| 4,764,316 | 8/1988 | Brown et al. | 264/3.1 |
| 4,860,654 | 8/1989 | Chawla et al. | 102/307 X |
| 4,958,569 | 9/1990 | Mandigo | 102/307 X |
| 5,090,324 | 2/1992 | Bocker et al. | 102/307 |
| 5,098,487 | 3/1992 | Brauer et al. | 102/307 X |
| 5,175,391 | 12/1992 | Walters et al. | 102/307 |
| 5,221,808 | 6/1993 | Werner et al. | 102/307 |
| 5,415,101 | 5/1995 | Brinkmann | 102/307 |

*Primary Examiner*—Peter A. Nelson

*Attorney, Agent, or Firm*—Victor E. Libert; Frederick A. Spaeth

[57] ABSTRACT

A liner (30) for a shaped charge (10) has a hemispherical apex and a skirt portion (38) which terminates in a circular skirt edge (40) having a skirt edge diameter (D). The apex (36) has a radius of curvature which is less than the skirt edge diameter (D) and the thickness (Tac) of the liner at the center of the apex (36) is greater than the thickness (Ts) of the liner at the skirt edge (40), with the thickness tapering between the apex and the skirt edge in a smooth, curvilinear transition. The liner (30) may be employed in a shaped charge (10) which includes a shaped explosive (26) which has been compressed to at least 95% of its theoretical maximum density and is contained in a housing (12) and cover (20) made of a pulverable material such as a ceramic. A chamber (22) is provided in the base of the housing (12) to receive a pre-compressed initiation pellet (24) and the housing has a slot (42) formed in its base (14) to receive and retain therein a linear explosive member in close proximity to the initiation pellet (24) retained within the chamber.

15 Claims, 2 Drawing Sheets

LINER AND IMPROVED SHAPED CHARGE ESPECIALLY FOR USE IN A WELL PIPE PERFORATING GUN

BACKGROUND OF THE INVENTION

1. Field of the Invention

The present invention is concerned with explosive shaped charges, and more particularly to an improved liner for use in such shaped charges and an improved shape charge which is especially useful in a well pipe perforating gun.

2. Related Art

The use of shaped charges for perforating the pipes or casings used to line wells such as oil and natural gas wells and the like, is well-known in the art. For example, U.S. Pat. No. 3,128,701, issued Apr. 14, 1964 to J. S. Rinehart et al, discloses a shaped charge perforating apparatus for perforating oil well casings and well bore holes.

The art has also devoted attention to providing a particular configuration of the shaped charge and its liner as shown, for example, in U.S. Pat. No. 5,221,808, issued Jun. 22, 1993 to A. T. Werner et al. The shaped charge therein disclosed includes the usual case, concave shaped explosive material packed against the inner wall of the case, and a metal liner lining the concave side of the shaped explosive. As disclosed in the paragraph bridging columns 3 and 4 of the patent, the taper is said to exist in the thickness of the liner 14 starting at the apex 18 thereof and ending with the skirt 16 thereof. At the first ten lines of column 4, specifications are given for the copper-bismuth liner 14 including a maximum variation in thickness along any given transverse section of the liner, a specified thickness of the skirt 16 of the liner 14, and the taper of the liner at the apex 18 and the skirt 16. It is not clear from the face of the patent precisely what is meant by the different specified "tapers" at the apex and the skirt.

Generally, shaped charges utilized as well perforating charges include a generally cylindrical or cup-shaped housing having an open end and within which is mounted a shaped explosive which is configured generally as a hollow cone having its concave side facing the open end of the housing. The concave surface of the explosive is lined with a thin metal liner which, as is well-known in the art, is liquified to form a jet of molten material upon detonation of the explosive and this jet of molten material exhibits a good penetrating power to pierce the well pipe, its concrete liner and the surrounding earth formation. Typically, the shaped charges are configured so that the liners along the concave surfaces thereof define simple conical liners with a small radius apex at a radius angle of from about 55° to 60°. Other charges have a hemispherical apex fitted with a liner of uniform thickness.

Generally, explosive materials such as HMX, RDX or HNS are mixed with binders such as wax or synthetic polymeric reactive binders such as that sold under the trademark KEL-F. The resultant mixture is cold- or hot-pressed to approximately 90% of its theoretical maximum density directly into the shaped charge case. The resulting shaped charges are initiated by means of a booster or priming charge positioned at or near the apex of the shaped charge and located so that a detonating fuse, detonating cord or electrical detonator may be positioned in close proximity to the priming charge.

The known prior art shaped charges are typically designed as either deep-penetrating charges or large-diameter hole charges. Generally, shaped charges designed for use in perforating guns contain 50 to 60 grams of high explosive and those designed as deep-penetrating charges will typically penetrate concrete up to about 12 inches. Large-diameter hole shaped charges for perforating guns create holes on the order of about one inch in diameter and display concrete penetration of up to about 9 inches. Such data have been established using API RP43, Section II test methods. Generally, typical disposable charges are not designed to withstand deep well pressures in excess of about 13,000 psi.

SUMMARY OF THE INVENTION

In accordance with the present invention, there is provided a liner for a shaped charge, the liner having a convex outer surface, a concave inner surface, a closed end defining an apex having a center and a skirt portion terminating at an opposite, open end of the liner in a circular skirt edge having a skirt edge diameter. The apex has a radius of curvature which is from about 35% to 45%, e.g., from about 39% to 41%, of the skirt edge diameter. The thickness of the liner at the center of the apex is from about 5% to 50%, e.g., from about 10% to 40%, greater than the thickness of the liner at the skirt. The thickness of the liner between the apex and the skirt edge tapers in a smooth, curvilinear transition between the apex and the skirt edge.

In one aspect of the present invention, the liner is in combination with a shaped charge comprising a housing containing a shaped explosive having a convex side, the shaped explosive being mounted within the housing and the liner lining the concave side of the shaped explosive within the housing.

Another aspect of the invention provides that the shaped charge with which the liner is combined may be mounted in a perforating gun.

In accordance with another aspect of the present invention, there is provided a shaped charge comprising a housing having an inner wall, an outer wall, a base, a mouth portion opposite the base and, optionally, a cover closing the mouth of the opening. A shaped explosive having an open concave side is mounted on the inner wall of the housing with the concave side of the shaped explosive facing the mouth portion of the housing. The explosive is compressed to at least about 95% of its theoretical maximum density and a liner lines the concave side of the shaped explosive. Optionally, the shaped charge may be mounted in a perforating gun.

Another aspect of the invention provides that the housing is comprised of a pulverable material and has formed within its base a chamber which is dimensioned and configured to receive therein a pre-compressed initiation pellet and to retain the pellet in explosive signal communicating proximity to the shaped explosive. A pre-compressed initiation pellet may be retained within the chamber.

Yet another aspect of the invention provides for the housing to have a slot formed in the base thereof adjacent to the chamber, the slot being dimensioned and configured to receive and retain therein a linear explosive member in explosive signal communicating proximity to an initiation pellet retained in the chamber. A linear explosive member may be received within the slot.

Yet another aspect of the invention provides that one or both of the housing and the cover may be made of a pulverable material, such as ceramic material, e.g., alumina.

DETAILED DESCRIPTION OF THE INVENTION AND PREFERRED EMBODIMENTS THEREOF

The configuration of the liner of the present invention is such that, when used in conjunction with a shaped charge whose explosive charge is shaped to fit the liner, especially when using the highly compressed shaped explosive described herein, results in enhanced performance of the charge with respect to depth of penetration and size of the hole formed by the shaped charge. Such shaped charge finds particular utility as a component of a perforating gun of the type used to penetrate well pipes or casings such as those of oil and natural gas wells as is known in the art of extracting petroleum, natural gas and other fluid substances from the earth. Shaped charges in accordance with the present invention, and shaped charges configured to utilize the liner of the present invention are particularly well adapted for use with the novel perforator gun system disclosed in co-pending patent application Serial No. 08/379,303 of C. A. Dieman, Jr. et al, entitled "Well Pipe Perforating Gun" and filed concurrently herewith.

Figure 1:
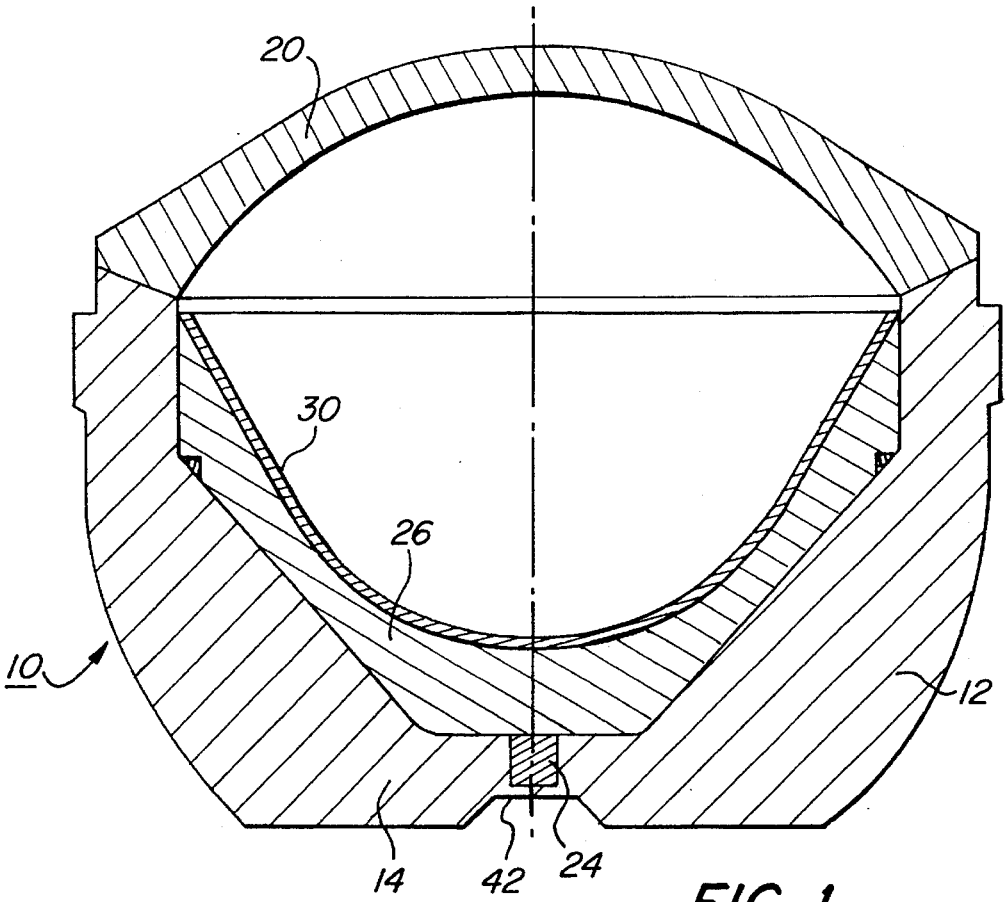
FIG. 1 is a cross-sectional view of a pressure sealed shaped charge in accordance with one embodiment of the present invention.
Figure 2:
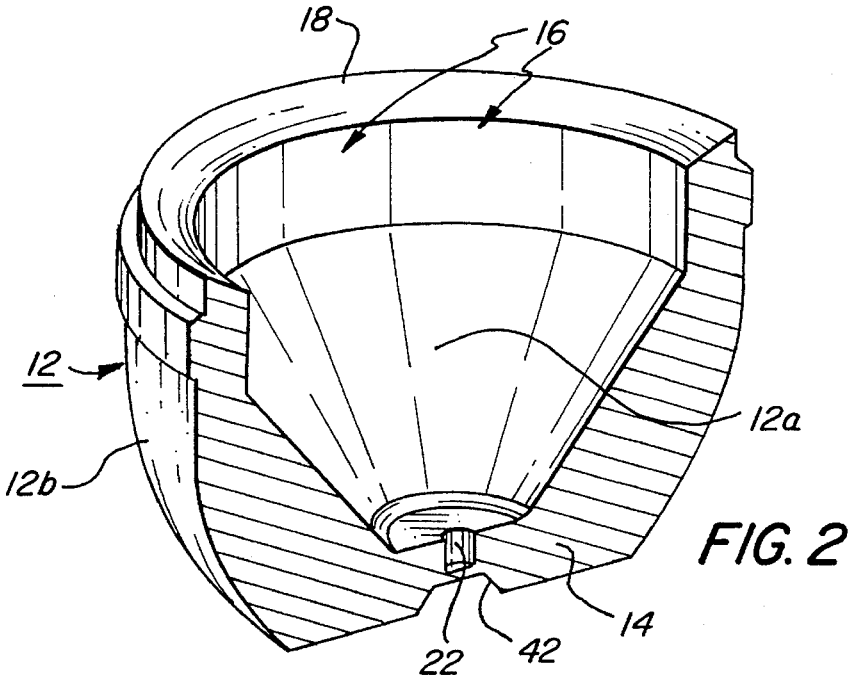
FIG. 2 is a perspective view of a longitudinal section of the housing of the shaped charge of FIG. 1.

Referring now to FIG. 1, there is shown a shaped charge 10 in accordance with one embodiment of the present invention comprising a housing 12 having (FIG. 2) an inner wall 12*a*, an outer wall 12*b*, a base 14 and a mouth portion 16 opposite the base 14. The mouth portion 16 of housing 12 is defined by a chamfered lip 18 (FIG. 2) on which is received a complementary shaped lip (unnumbered) of a cover 20. The base 14 has formed within it a chamber 22 (best seen in FIG. 2A) within which is received a pre-compressed initiation pellet 24 (FIG. 1). The pre-compressed pellet is any suitable primary explosive and is referred to as "pre-compressed" because, in a preferred embodiment wherein housing 12 is made of a pulverable material such as a ceramic, initiation pellet 24 is compressed prior to being inserted into chamber 22, i.e., is "pre-compressed" in order to avoid imposing on housing 12 the stresses which it would have to endure if pellet 24 were compressed while within chamber 22.

A shaped explosive 26 (FIG. 1) is of generally concavo-convex configuration and is mounted within housing 12 and retained therein mounted upon inner wall 12*a* thereof by adhesive applied to the entire surface of inner wall 12*a*. A liner 30 is mounted by any suitable means such as an adhesive on the concave surface of shaped explosive 26.

Figure 3A:
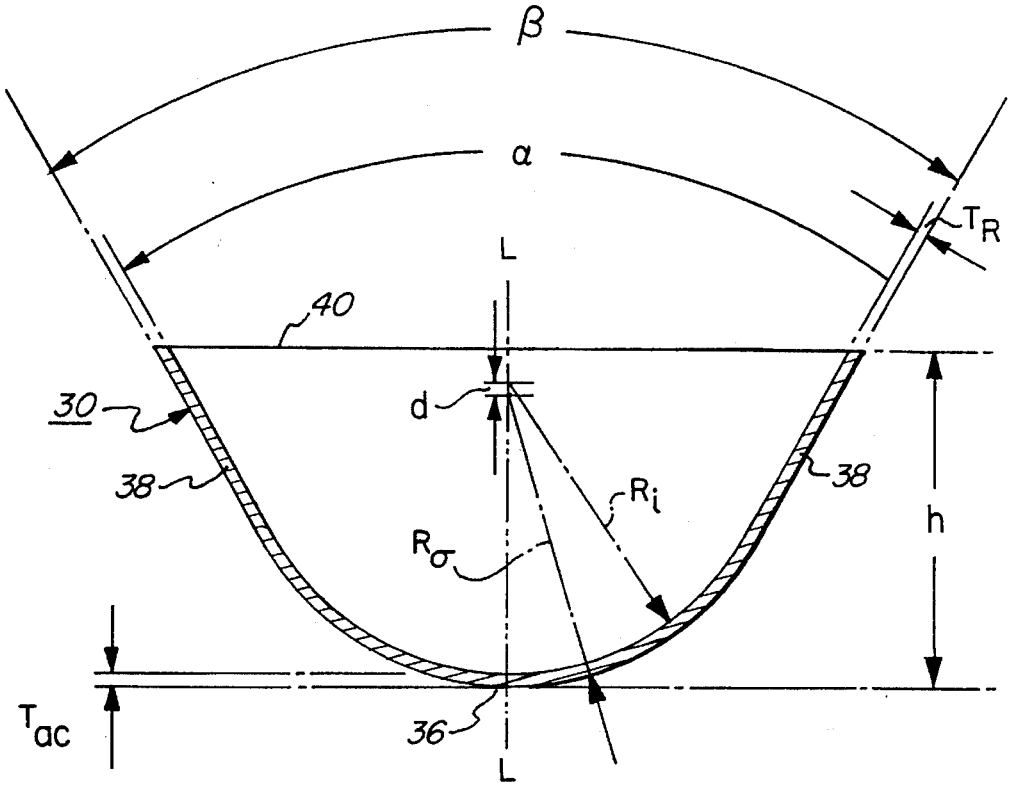
FIG. 3A is a section view, enlarged relative to FIG. 3, taken along line A—A of FIG. 3 along the longitudinal axis of the liner.
Figure 3:
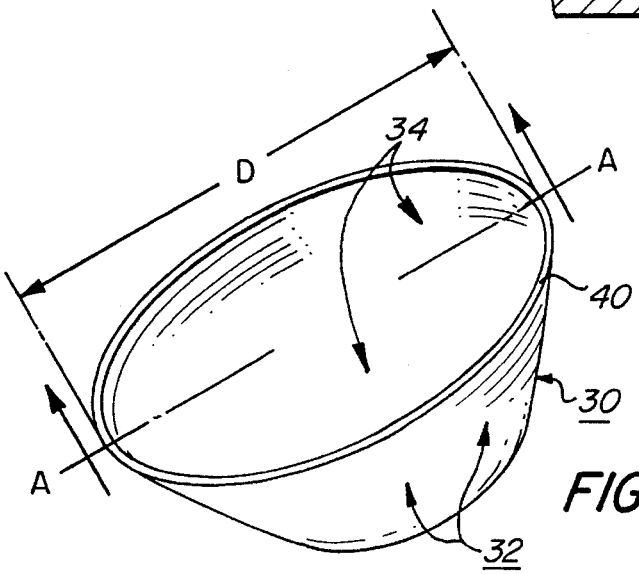
FIG. 3 is a perspective view of the liner of the shaped charge of FIG. 1.

Referring now to FIGS. 3 and 3A, liner 30 is also of generally concavo-convex configuration and is seen to have a convex outer surface 32 and a concave inner surface 34. The closed end of shaped charge liner 30 defines a liner apex 36 (FIG. 3A) which is separated from the opposite, open end of shaped charge liner 30 by a skirt 38 which terminates in a circular skirt edge 40. The central, longitudinal axis of liner 30 is indicated by dot-dash line L—L in FIG. 3A, the longitudinal axis L—L passing through the center of the liner apex 36 and through the center of a circle defined by an imaginary plane lying perpendicular to longitudinal axis L—L and passing through and bounded by skirt edge 40. The skirt edge diameter D of liner 30 is shown by the correspondingly lettered dimension arrow in FIG. 3. The inner apex radius of curvature $R_i$ and the outer apex radius of curvature $R_o$ have, as seen in FIG. 3A, origins which are slightly displaced relative to each other along longitudinal axis L—L with the origin of $R_o$ being closer to apex 36 than is the origin of $R_i$. The amount of displacement d plus the difference between $R_i$ and $R_o$ when both are taken along longitudinal axis L—L, is thus equal to the thickness Tac of the liner 30 at the center of liner apex 36. The different lengths and displaced origins of the radii $R_i$ and $R_o$ provide a smooth, curvilinear transition between the thickness Tac and the thickness Ts to provide a non-uniform, tapered change in thickness in moving from the center of liner apex 36 to skirt edge 40. As used herein and in the claims, reference to the radius of curvature of the apex shall mean the average of $R_i$ and $R_o$ along the hemispherical portion of the liner. Generally, the radius of curvature of the apex $(R_i+R_o/2)$ is from about 35% to 45%, e.g., from about 39% to 41%, of the skirt edge diameter D. The thickness of the liner 30 at skirt edge 40 is shown by the dimension Ts in FIG. 3A. Generally, the thickness Tac of the liner at the center of the apex is about 5% to 50%, e.g., from about 10% to 40%, specifically 25%, thicker than the thickness Ts of the liner at the skirt edge 40. As seen in cross section in FIG. 3A, the angle $\alpha$ formed between diametrically opposite sides of the inner surface 34 of liner 30 is slightly larger than the corresponding angle formed by the outer surface 32 of liner 30. For example, in a preferred embodiment, angle $\alpha$ may measure 60.00 degrees and angle $\beta$ may measure 59.55 degrees. Other preferred measurements for the liner 30 are that the diameter D may be 2.681 inches, the depth h of the liner may be 1.231 inches, the dimension Ts may be 2.70 to 2.71 cm), $R_o$ may be from about 1.094 to 1.100 from about 0.031 to 0.037 inches (about 0.787 to 0.940 mm), $R_i$ may be from about 1.065 to 1.067 inches (about inches and Tac may be from about 0.040 to 0.046 inches (about 1.016 to 1.168 mm). In such case, the displacement d may be from about 0.027 to 0.035 inch (about 0.686 to 0.889 mm). The skirt edge diameter D may be from about 2.5 to 2.7 inches (about 6.35 to 6.86 cm).

The depth h of liner 30 is that taken along longitudinal axis L—L from the outer surface 32 of liner 30 to the center of the imaginary plane passed through skirt edge 40 and may be from about 1.1 to 1.3 inches (about 2.79 to 3.30 cm).

The pre-compressed initiation pellet 24 and shaped explosive 26 shown in FIG. 1 may each be made of any suitable explosive material. The shaped explosive 26 may comprise from about 40 to 60 grams, e.g., 50 grams, of a suitable explosive containing a small amount of binder, such as HMX containing 5% by weight of the total weight of explosive of a suitable binder such as a plastic (synthetic polymeric) binder. The shaped explosive 26 is preferably pressed under vacuum at high temperature in order to remove residual air and reflow the binder. Such molding technique enables the production of a shaped explosive having a density of at least 95% of the theoretical maximum density for that explosive. This ultra-high density of the shaped explosive increases detonation performance which generally increases exponentially as a function of density of the explosive.

The housing 12 and cover 20 may be made of any suitable material but a pulverable material which will be rendered as a dust or powder upon detonation of shaped charge 26 is preferred, as explained in detail in the above-mentioned co-pending patent application Ser. No. 08/379,303 . A preferred material is a 94% alumina ceramic sold by the Coors Ceramic Company under the designation Coors AD-94. Such material has a very high compressive strength and the design of housing 12 and cover 20 is such that the shaped charge 10 is subjected to great pressure, as would be sustained upon being lowered into very deep wells for oil and natural gas extraction, e.g., pressures of up to about 22,000 psi, the housing and cover would be placed under compressive load but under virtually no tensile loads, thus taking advantage of the characteristics of the pulverable material used in construction of the housing and cover. Typically, cover 20 may be secured to housing 12 by a suitable adhesive.

The liner may be made of any suitable metal but is preferably spun from an oxygen-free copper alloy sheet, for example, one designated C101OO IAW ASTM F68-77, temper 070. Spinning of the copper is a one-step operation whereby the copper is not only machined to the proper shape and thickness as described herein, but at the same time the grain structure of the copper becomes properly oriented so as to provide optimum performance upon detonation.

A slot 42 is formed in the base 14 of housing 12 to receive therein a linear explosive member such as detonating cord or detonating ribbon. The detonating cord or detonating ribbon is retained within slot 42 by suitable means (not shown) which are employed to mount a plurality of shaped charges 10 within a perforating gun assembly, all as disclosed in the above-mentioned co-pending patent application Ser. No. 08/379,303.

Figure 2A:
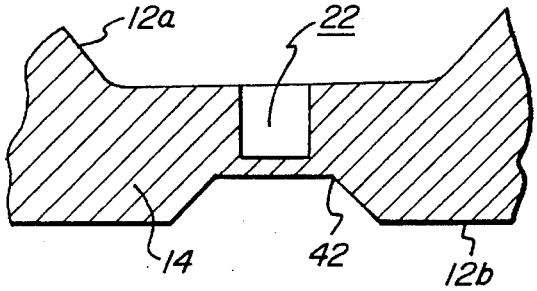
FIG. 2A is a view, enlarged relative to FIG. 2, of the center of the base of the housing of FIG. 2.

Pre-compressed initiation pellet 24 is preferably configured with a length-to-diameter ratio which allows the detonation wave formed by detonation of initiation pellet 24 to "flatten" to a planar spot at the interface with the shaped charge 26. Centering of the initiation pellet 24 relative to shaped charge 26 maximizes the symmetry of the resulting detonation wave generated by detonation of initiation pellet 24 as it impinges upon shaped explosive 26, further optimizing penetration performance of the shaped charge of the invention. Initiation pellet 24 is of course initiated by detonation of the linear explosive member received and maintained within slot 42. The shock wave resulting from detonation of the linear explosive member transfers through the thin wall of base 14 which separates slot 42 from initiation pellet 24, as best seen in FIGS. 1 and 2A.

EXAMPLE

Shaped charges configured as shown in FIG. 1 for shaped charge 10 and meeting the following specifications were utilized to perforate a N-80 twenty-three pound steel pipe (American Petroleum Institute specification) having a nominal 0.415 inch (1.054 cm) wall thickness.

Test Shaped Charges Liner (Item 30 in FIG. 1)

| Dimensions[1] | | |
|---|---|---|
| Tac | 0.043 inch | (1.092 mm) |
| Ts | 0.034 inch | (0.864 mm) |
| R[2] | 1.082 inch | (2.748 mm) |
| D | 2.681 inch | (6.810 cm) |
| h | 1.231 inch | (3.127 cm) |
| α | 60.00 degrees | |
| β | 59.55 degrees | |

[1]As in FIG. 3A

[2]Nominal radius of curvature, approximately the average of $R_i$ and $R_o$

Shaped Explosive (Item 26 in FIG. 1)

55 to 56 grams of HMX containing 4.7 to 5.0% by weight (of the total weight of explosive plus binder) of a polyurethane elastomer (MIL-P-63196 military specification) sold by the B.F. Goodrich Company under the trademark ESTANE. The shaped explosive was pre-compressed to at least 95% of its total maximum density.

Liner Material

Spun copper made from oxygen-free copper alloy sheet C101OO IAW ASTM F68-77, temper 070.

Case Material

The case, comprised of housing and cover (Items 12 and 20, respectively, in FIG. 1) is made of Coors AD-94 alumina ceramic.

In eleven tests, the diameter of the entrance hole in the steel pipe averaged 1.29 inches, the minimum diameter being 1.16 inches and the maximum diameter 1.60 inches in eleven tests. The depth of penetration of the shaped charges into concrete was tested and averaged 11.3 inches, with a mimimum penetration of 10.0 inches and a maximum penetration of 14.0 inches in three tests.

Although the invention has been described in detail in connection with specific preferred embodiments thereof, it will be appreciated that variations thereto may be made which nonetheless lie within the spirit and scope of the invention and the appended claims.

What is claimed is:

1. A liner for a shaped charge, the liner having a convex outer surface, a concave inner surface, a closed end defining an apex having a center and a skirt portion terminating at an opposite, open end of the liner in a circular skirt edge having a skirt edge diameter, the apex having a radius of curvature which is from about 35% to 45% of the skirt edge diameter, and the thickness of the liner at the center of the apex is from about 5% to 50% greater than the thickness of the liner at the skirt edge, with the thickness of the liner between the apex and the skirt edge tapering in a smooth curvilinear transition between the apex and the skirt edge.

2. The liner of claim 1 wherein the radius of curvature of the apex is from about 39% to 41% of the skirt edge diameter and the thickness of the liner at the center of the apex is from about 10% to 40% greater than the thickness of the liner at the skirt edge.

3. The liner of claim 1 wherein the thickness of the liner at the center of the apex is from about 0.040 to 0.046 inch (about 1.016 to 1.168 mm) and the thickness of the liner at the skirt edge is from about 0.031 to 0.037 inch (about 0.787 to 0.940 mm).

4. The liner of claim 3 wherein the skirt edge diameter is from about 2.5 to 2.7 inches (about 6.35 to 6.86 cm) and the depth of the liner measured along the longitudinal axis thereof from the outside surface of the center of the apex to a plane passed perpendicularly to the longitudinal axis at the skirt edge is from about 1.1 to 1.3 inches (about 2.79 to 3.30 cm).

5. The liner of any one of claims 1 to 4 inclusively in combination with a shaped charge comprising a housing containing a shaped explosive having a convex side, the shaped explosive being mounted within the housing and the liner lining the concave side of the shaped explosive within the housing.

6. The liner of claim 5 wherein the shaped charge with which the liner is combined is mounted in a perforating gun.

7. A shaped charge comprising a housing having an inner wall, an outer wall, a base and a mouth portion opposite the base;

a shaped explosive having an open concave side and mounted on the inner wall of the housing with the concave side of the shaped explosive facing the mouth portion of the housing, the explosive being compressed to at least about 95% of its theoretical maximum density; and a liner lining the concave side of the shaped explosive.

8. The shaped charge of claim 7 wherein the housing is comprised of a pulverable material and has formed within its base a chamber which is dimensioned and configured to receive therein a pre-compressed initiation pellet and retain the pellet in explosive signal communicating proximity to the shaped explosive.

9. The shaped charge of claim 8 further including a pre-compressed initiation pellet retained within the chamber.

10. The shaped charge of claim 8 or claim 9 wherein the housing has a slot formed in the base thereof adjacent to the chamber, the slot being dimensioned and configured to receive and retain therein a linear explosive member in explosive signal communicating proximity to an initiation pellet retained in the chamber.

11. The shaped charge of claim 10 further including a linear explosive member received within the slot.

12. The shaped charge of claim 7 or claim 8 further comprising a cover closing the mouth of the housing.

13. The shaped charge of claim 12 wherein the cover is made of a pulverable material.

14. The shaped charge of claim 13 wherein the housing and the cover are made of a ceramic material.

15. The shaped charge of claim 7 or claim 8 mounted in a perforating gun.

* * * * *

UNITED STATES PATENT AND TRADEMARK OFFICE

CERTIFICATE OF CORRECTION

PATENT NO. : 5,509,356

DATED : April 23, 1996

INVENTOR(S) : Steven L. Renfro

It is certified that error appears in the above-indentified patent and that said Letters Patent is hereby corrected as shown below:

In the Drawings:

In Figure 3A, replace "Rσ" with --Ro--.

FIG. 3A

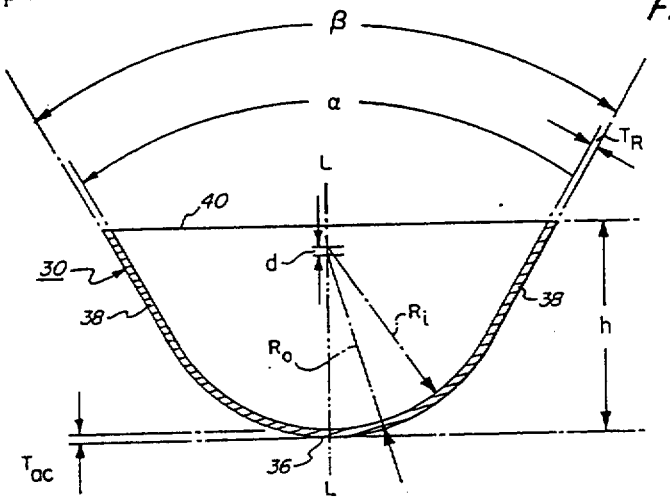

Signed and Sealed this

Eighth Day of October, 1996

Bruce Lehman

*Attest:*

BRUCE LEHMAN

*Attesting Officer*

*Commissioner of Patents and Trademarks*